United States Patent [19]

Armand

[11] 4,381,976

[45] May 3, 1983

[54] PROCESS FOR THE PREPARATION OF TITANIUM BY ELECTROLYSIS

[75] Inventor: Marcel Armand, Meylan, France

[73] Assignee: Pechiney Ugine Kuhlmann, Paris, France

[21] Appl. No.: 313,228

[22] Filed: Oct. 20, 1981

[30] Foreign Application Priority Data

Nov. 27, 1980 [FR] France ..... 80 25506

[51] Int. Cl.[3] ..... C25C 3/28

[52] U.S. Cl. ..... 204/64 T

[58] Field of Search ..... 204/64 T

[56] References Cited

U.S. PATENT DOCUMENTS 2,975,111 3/1961 Reinert et al. ..... 204/64 T

*Primary Examiner*—Howard S. Williams

*Attorney, Agent, or Firm*—Dennison, Meserole, Pollack & Scheiner

[57] ABSTRACT

The process which is the subject of this invention concerns the preparation of titanium by electrolysis from a bath of molten halides.

It comprises effecting partial reduction of the $TiCl_4$ which is used as the starting material in a separate reaction vessel, and then directly feeding the electrolyzing apparatus by means of titanium halides with a valency of less than 3. The partial reduction of the $TiCl_4$ is effected by means of divided titanium or another metal such as Na.

1 Claim, 2 Drawing Figures

PROCESS FOR THE PREPARATION OF TITANIUM BY ELECTROLYSIS

The process which is the subject of this application concerns the preparation of titanium by the electrolysis of molten halides. More particularly it concerns the electrolysis of titanium dissolved in an electrolyte based on chlorides, using titanium tetrachloride as the starting material.

Various works are already known, which disclose the preparation of titanium from $TiCl_4$ by the electrolysis of chlorides.

Thus, Report RI 7648 by USBM, published in 1972, describes an electrolysis cell for producing Ti by means of such a process. The drawings hereinafter make it possible better to understand the process described in that Report, and the improved process which is the subject of this invention.

Figure 1:
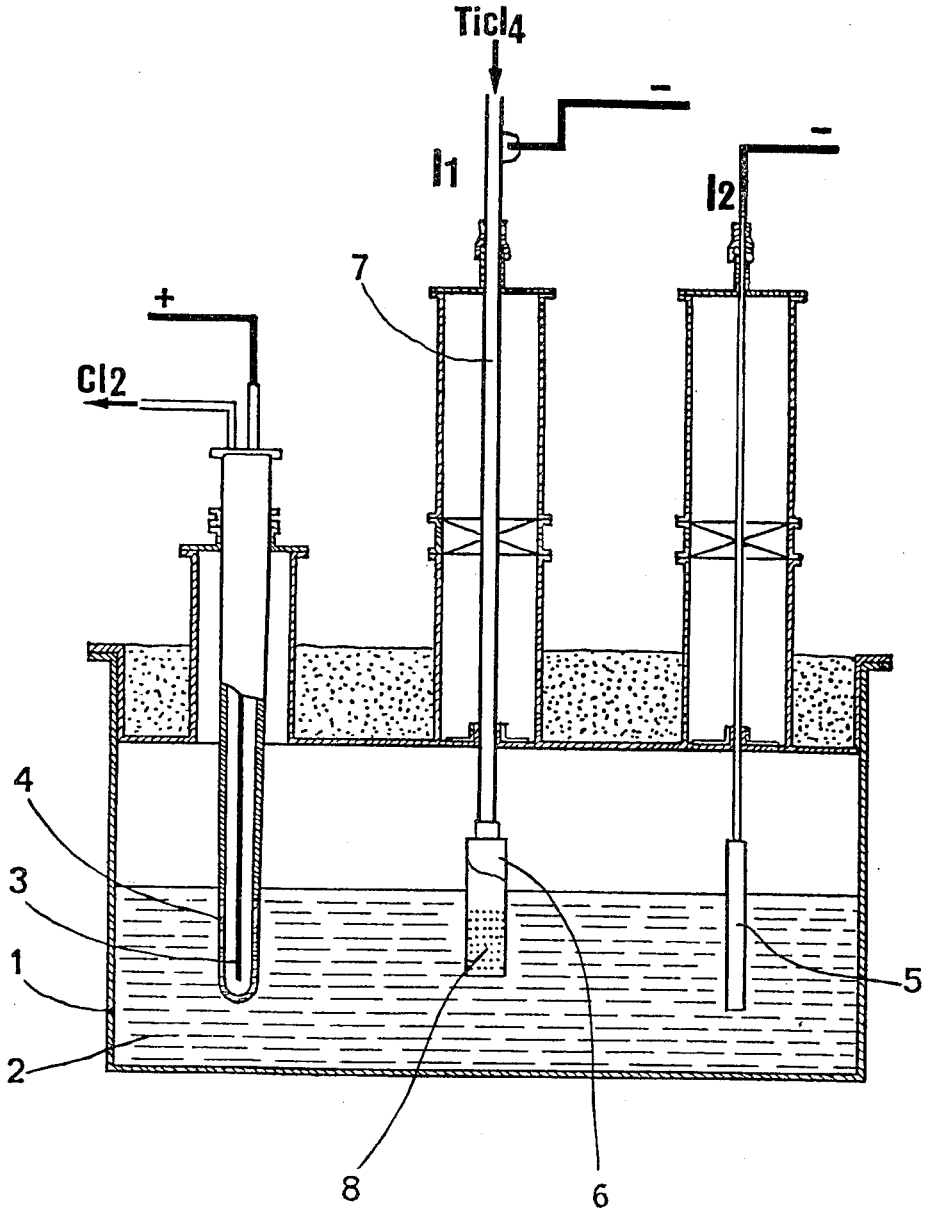
Figure 2:
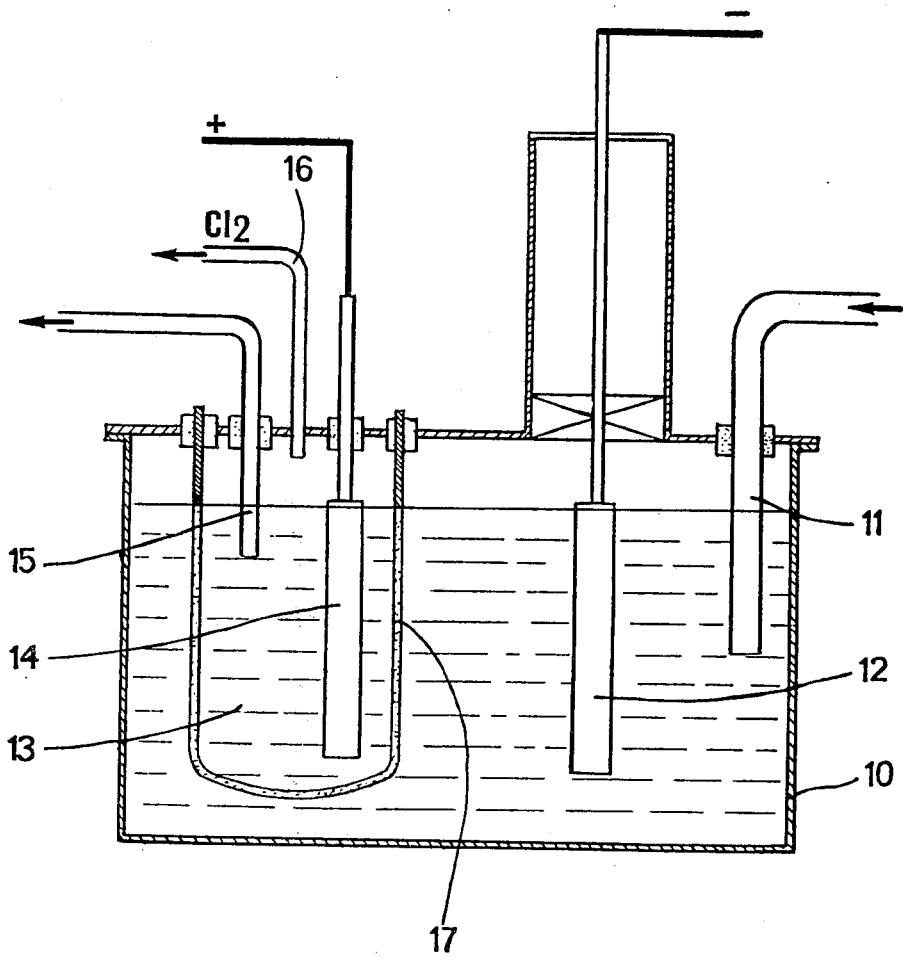

FIG. 1: electrolysis cell for carrying out the process described in USBM Report RI 7648, and FIG. 2: electrolysis cell for carrying out the process according to this invention.

The electrolysis cell shown in FIG. 1 comprises a container 1 which is heated from the outside at about 520° C. and which contains a molten electrolyte 2, based on a LiCl KCl mixture, in which from 8 to 12% of $TiCl_2$ is dissolved.

An anode 3 surrounded by a porous diaphragm 4 is connected to the positive terminal and a deposit cathode 5 is connected to the negative terminal. In order to maintain the concentration in respect of $Ti^{++}$ in the electrolyte at the desired level, it is necessary for $TiCl_4$ to be introduced continuously or discontinuously into the electrolyte, in order to replace the titanium which is fixed at the cathode.

The operation of introducing $TiCl_4$ is carried out by means of a feed cathode 6 which comprises a $TiCl_4$ intake pipe 7, the perforated end 8 of which is immersed in the electrolyte. The electrolysis current I which passes through the electrolyte from the anode is divided into two parts: a current $I_1$ which passes through the feed cathode 6 and a current $I_2$ which passes through the deposit cathode. Indeed, in order for electrolysis to be performed under satisfactory conditions, the titanium must be present in the electrolyte, in divalent form. Therefore, the titanium which is introduced in a state of valency of 4, in the form of $TiCl_4$, has to be reduced to a state of valency of close to 2. This result is achieved when the flow rate in respect of $TiCl_4$ and the intensity of the current $I_1$ which passes through the feed cathode are suitably adjusted. With a 100% ampere efficiency theoretically the $TiCl_4$ flow rate in g/h should be equal to I (ampere) multiplied by 1.772. The current $I_1$ should then be equal to ½ of I. Experience has shown that the mode of operation of the feed cathode is fairly delicate. It is difficult to ensure that the $TiCl_4$ flow is at a regular rate and the dangers of the intake conduit being blocked by the electrolyte are not negligible.

Likewise, the fact that the $TiCl_4$ bubbles into the electrolyte causes agitation, which is often violent, thereby disturbing the electrolysis operation.

Theoretical studies have shown that the phenomenon in regard to reduction of $TiCl_4$ to $TiCl_2$, in relation to the feed cathode, is a complex one. It may be described in a simplified manner by the following reactions: firstly, the $TiCl_4$ introduced reacts on the $TiCl_2$ which is dissolved in the electrolyte, in accordance with the following reaction:

$$TiCl_4 + TiCl_2 \rightarrow 2\ TiCl_3 \quad (1)$$

At the location of the feed cathode, by virtue of the current $I_1$, ions $Ti^{2+}$ are discharged:

$$Ti^{2+} + 2e^- \rightarrow Ti^0 \quad (2)$$

The Ti formed reacts in turn with the $TiCl_3$ which is dissolved in the electrolyte, in accordance with the equilibrium reaction:

$$Ti^0 + 2TiCl_3 \rightleftharpoons 3TiCl_2 \quad (3)$$

In total, the reaction may be represented generally in the following manner:

$$TiCl_4 + Ti^{2+} + 2e^- \rightarrow 2TiCl_2 \quad (4)$$

It will be seen that one of the difficulties is because reaction (1) and reaction (3) may very readily occur at different points in the electrolyte, in particular if the electrolyte is severely agitated by the introduction of the $TiCl_4$. In that case, more or less substantial deposits of Ti may be observed at certain points on the feed cathode, while at the same time, the $TiCl_3$ content of the electrolyte increases, which may be a cause for re-dissolution of the titanium on the deposit cathode.

Moreover, as reaction (3) is an equilibrium reaction, supplying the cathode with a current $I_1 = (I/2)$ normally results in a deposit of Ti.

Therefore, research has been made into the possibility of very substantially simplifying the design of electrolysing apparatuses for the preparation of titanium, in order to provide for stable operation thereof.

In particular, a way has been sought of avoiding the disturbances caused by the movements of the bath which are due to the introduction of liquid or gaseous $TiCl_4$. Endeavours have also been made to avoid the variations in concentration and valency of the titanium which is dissolved in the bath.

The process according to the present invention concerns the production by electrolysis of the titanium dissolved in halide form in an electrolyte based on at least one alkali or alkaline earth halide. It is characterised by the use of a feed device which provides for the introduction into the cathodic region of the electrolysis cell, of the titanium in the form of a halide or a mixture of halides with a mean valency of less than 3. In accordance with a preferred manner of performance of the invention, the titanium halides are titanium chlorides produced by partial reduction of $TiCl_4$. The reducing agent used may be an alkali or alkaline-earth metal or alloys of said metals or titanium or an alloy of titanium.

The operation of reducing $TiCl_4$ to the desired valency level is performed by means of the reducing agent selected, in a separate installation. The titanium chloride or chlorides with a mean valency of less than 3 are in most cases produced in solution in a molten alkali or alkaline earth halide or mixture of such halides. The molten mixture which is produced in that way is progressively introduced into the cathodic compartment of the electrolysis apparatus, as required. At the same time, a corresponding amount of electrolyte which has a reduced content in respect of titanium halides is extracted from the anodic compartment.

FIG. 2 is a diagrammatic view of an electrolysis cell 10 for the production of titanium, for carrying out the process according to the invention. The cell is heated from the outside by a means not shown in the drawing. It will be seen that in this case the relatively complicated arrangement of the feed cathode as described hereinbefore is replaced by a simple feed pipe 11 which provides for the introduction of the mixture of molten halides containing titanium, in the form of ions with a mean valency of less than 3, into the cathodic compartment. The pipe 11 is connected to an installation (not shown) in which $TiCl_4$ is partially reduced. The cell further comprises a deposit cathode 12 on which the titanium is deposited. It will be noted that a take-off pipe 15 is disposed in the anodic compartment 13, beside the anode 14, the pipe 15 providing for extraction from the cell of the amounts of electrolyte which are equivalent to the amounts introduced by way of the pipe 11. A pipe 16 permits the chlorine formed at the anode to be given off.

By virtue of the provision of the diaphragm 17, the electrolyte which is drawn off in the above-described manner contains only very little titanium in solution.

Many embodiments of the process according to the invention may be envisaged. In particular, it is possible to use different methods for reducing the titanium tetrachloride.

The following Examples provide a non-limiting description of two particularly advantageous embodiments of the process.

EXAMPLE 1

A first method of reducing the titanium tetrachloride comprises performing the reduction operation by means of metallic titanium. Such an operation is particularly justified where there is access to titanium or titanium-base alloy scrap, in the divided state, such as turnings, reject ends of plates, etc. It is also possible to use titanium sponge as the reducing means, and in particular, sponge which is not in a sufficient degree of purity for direct use thereof. Finally, it is also possible to use electrolytic titanium to which a high degree of reactivity is imparted by its crystalline structure which is generally fairly loose.

The following reactions are performed:

$$Ti + 3TiCl_4 \rightarrow 4TiCl_3 \quad (5)$$

then $$2Ti + 4TiCl_3 \rightleftarrows 6TiCl_2 \quad (6)$$

Operation is generally in a steel reaction vessel in which the titanium waste is placed. After heating to the appropriate temperature in a neutral atmosphere, the $TiCl_4$ is progressively introduced. It is generally desirable for a certain amount of electrolyte which preferably originates from the anodic compartment of the electrolysing apparatus to be introduced into the reaction vessel, so as to dissolve the titanium subchlorides which are formed. Indeed, introducing such titanium subchlorides in the solid state into the cathodic compartment of the electrolysing apparatus would give rise to more serious difficulties than introducing them in the form of a mixture of molten salts. In the case for example of electrolysis in a LiCl-KCl medium, there is introduced into the reaction vessel an amount of said electrolyte, which is taken from the anodic compartment of the electrolysing apparatus, such that, after reduction of $TiCl_4$ by titanium, the amount of titanium subchlorides in the mixture of molten salts is of the order of from 8 to 12%. As reaction (6) is an equilibrium reaction, it is not possible to achieve complete reduction of $TiCl_3$ to $TiCl_2$. Moreover, it should also be noted that, during the operation of introducing $TiCl_4$ into the reaction vessel, there may be direct reaction of $TiCl_4$ on $TiCl_2$, as follows:

$$TiCl_4 + TiCl_2 \rightarrow 2TiCl_3 \quad (7)$$

Therefore, the result will generally be a mean valency in respect of the titanium in solution, of between 3 and 2. The mean valency of the titanium will more closely approach the valency corresponding to the equilibrium (6), in proportion as the excess of titanium increases in relation to the $TiCl_4$ introduced and in proportion to increasing specific surface area of that titanium. For the latter reason, it will be preferable to use titanium in the form of fine turnings or cuttings, sponge or, even better, electrolytic titanium crystals. The mixture of salts which is prepared in this way is finally introduced into the electrolysing apparatus by way of the conduit 11.

EXAMPLE 2

A second method comprises effecting the reduction operation by means of sodium. It is known in fact that $TiCl_4$ may be reduced by Na, in accordance with the following reactions:

$$TiCl_4 + Na \rightarrow TiCl_3 + NaCl \quad (8)$$

$$TiCl_3 + Na \rightarrow TiCl_2 + NaCl \quad (9)$$

giving in total $$TiCl_4 + 2Na \rightarrow TiCl_2 + 2NaCl \quad (10)$$

As in the case of reducing $TiCl_4$ by means of Ti, reaction (7) will also be noted here.

These reactions are carried out for example in a steel reaction vessel in which the sodium is put into a molten condition, protected from air, in the presence of an inert gas such as argon, and into which the $TiCl_4$ is progressively introduced, in the desired proportion. The resulting mixture of salts is then transferred in the liquid state into the electrolysis cell, by means of the feed pipe 11. It will be seen that, when sodium is used as the $TiCl_4$ reducing agent, it is desirable for the electrolyte used to be solely a mixture of sodium chloride and titanium sub-chlorides.

It is then possible to use the sodium chloride which is drawn from the anodic compartment, for again producing sodium by electrolysis by means of the usual procedure.

In some cases, it is also possible to draw from the anodic compartment, an additional amount of sodium chloride which will be used to dilute the mixture of salts which is prepared in accordance with reaction (7), in order thereby to produce a mixture of salts in which the proportion of titanium sub-chlorides is closer to that of the catolyte into which the mixture will be transferred by way of the conduit (11).

In all cases, it is desirable for the operations of introducing electrolyte into the cathodic compartment and taking off electrolyte from the anodic compartment to be performed continuously or semi-continuously, in order thereby to avoid surges and jolts in operation. For that purpose, the $TiCl_4$ may be reduced, also continuously, by Ti or Na.

Moreover, other reducing agents may be envisaged, for the preparation of the titanium subchlorides. In particular, it is possible to use other alkaline earth or alkali metals. It is also possible optionally to use reducing agents in the form of alloys of alkaline earth or alkali metals, such as alloys NaK or LiK or others.

I claim:

1. In a continuous electrolytic process for the production of titanium utilizing an electrolysis cell, wherein said electrolysis cell contains titanium in halide form dissolved in an electrolyte containing at least one alkali metal halide or alkaline earth halide, and said electrolysis cell includes a device for introducing into the cathodic region of the cell titanium in halide form having a mean valency of less than 3, the improvement comprising the preparation of this titanium halide by partial reduction of $TiCl_4$ utilizing an alkali metal, alkaline earth metal or alloy thereof and introducing said titanium halide at least intermittently into the cathodic region of said electrolysis cell while removing at least intermittently from the anodic region of the cell which is separated from the cathodic region of the cell by a diaphragm an equivalent amount of molten electrolyte.

* * * * *